US009265369B1

(12) United States Patent
Beliveau

(10) Patent No.: US 9,265,369 B1
(45) Date of Patent: Feb. 23, 2016

(54) PILLOW

(71) Applicant: Soft-Tex International, Inc., Waterford, NY (US)

(72) Inventor: John A. Beliveau, Morresville, NY (US)

(73) Assignee: SOFT-TEX INTERNATIONAL, INC., Waterford, NY (US)

( * ) Notice: Subject to any disclaimer, the term of this patent is extended or adjusted under 35 U.S.C. 154(b) by 0 days.

(21) Appl. No.: 14/820,583

(22) Filed: Aug. 7, 2015

Related U.S. Application Data

(60) Provisional application No. 62/181,867, filed on Jun. 19, 2015.

(51) Int. Cl.
*A47G 9/10* (2006.01)

(52) U.S. Cl.
CPC ..... *A47G 9/10* (2013.01); *A47G 9/1036* (2013.01)

(58) Field of Classification Search
CPC ..... A47G 2009/001; A47G 9/0215; A47G 9/0238; A47G 9/0253; A47G 9/10; A47G 2009/1018; A47G 9/1036; A47G 9/1054; A47C 7/38; A47C 7/383
USPC ..... 5/638, 636, 490, 725, 724, 652.1; D6/601
See application file for complete search history.

(56) References Cited

U.S. PATENT DOCUMENTS 4,445,241 A * 5/1984 Ender ..... A47C 27/006 5/490
4,665,575 A * 5/1987 Raught ..... A47C 21/046 441/128
4,914,772 A * 4/1990 Difloe ..... A47C 7/66 297/452.43
5,727,266 A * 3/1998 Pang ..... A47G 9/0253 5/490
5,991,945 A * 11/1999 Pang ..... A47G 9/0253 5/490
6,760,935 B1 * 7/2004 Burton ..... A47G 9/10 5/636
D672,183 S * 12/2012 Alletto, Jr. ..... D6/601
D672,184 S * 12/2012 Alletto, Jr. ..... D6/601
D672,186 S * 12/2012 Alletto, Jr. ..... D6/601
8,572,779 B2 11/2013 Pratt et al.
8,646,134 B1 2/2014 Alletto, Jr.
8,887,332 B2 * 11/2014 Alletto ..... A47G 9/10 5/490
9,015,883 B2 * 4/2015 Alletto ..... A47G 9/1036 5/490
9,155,408 B2 * 10/2015 Alletto, Jr. ..... A47G 9/1027
9,167,922 B1 * 10/2015 Holbrook ..... A47G 9/10
9,167,923 B1 * 10/2015 Holbrook ..... A47G 9/10
2012/0284924 A1 * 11/2012 Pratt ..... A47G 9/10 5/640
2014/0096323 A1 * 4/2014 Alletto ..... A47G 9/1036 5/644
2014/0189955 A1 * 7/2014 Alletto, Jr. ..... A47G 9/1027 5/636
2014/0317850 A1 * 10/2014 Alletto ..... A47G 9/1036 5/638
2015/0351563 A1 * 12/2015 Alletto ..... A47G 9/1036 5/636

* cited by examiner

*Primary Examiner* — Robert G Santos
(74) *Attorney, Agent, or Firm* — Heslin Rothenberg Farley & Mesiti P.C.

(57) ABSTRACT

A pillow with improved air flow is provided. The pillow includes a including an upper face, a lower face, four peripheral sides, a first gusset section and a first vent. The first gusset section extends along at least a portion of one of the peripheral sides. Also, at least a portion of the first vent configured as part of the upper face. In another aspect of the present invention, the first vent is configured to be a part of the upper face, one of the peripheral sides adjacent the first gusset and the lower face.

7 Claims, 3 Drawing Sheets

PILLOW

This application claims the benefit of U.S. Patent Application No. 62/181,867, filed Jun. 19, 2015, entitled "AIR COOL COMFORT MEMORY FOAM PILLOW SHELL," Our File No. 2947.025P. To the extent not included below, the subject matter disclosed in this application is hereby expressly incorporated into the present application in its entirety.

BACKGROUND OF THE INVENTION

The present invention generally relates generally to pillows. More particularly, the present invention relates to a pillow with improved air flow therethrough.

Conventional pillows provide a soft cushion on which to place the head of a user while resting or sleeping. However, conventional pillows, especially pillows that include memory foam as a filler, absorb heat while a user sleeps resulting in a warm and uncomfortable sleeping experience. Thus, a need exists for a pillow having improved air flow.

SUMMARY OF THE INVENTION

The shortcomings of the prior art are overcome and additional advantages are provided through use of a pillow constructed in accordance with one or more principles of the present invention. The pillow constructed in accordance with one or more aspects of the present invention may be used, for example, providing a comfortable sleeping experience by providing a cooling effect for a user that is sleeping or resting. Additionally, other uses may be made of the invention that fall within the scope of the claimed invention but which are not specifically described below such as, for example, body pillows and cushions.

The present invention provides, in a first aspect, a pillow including an upper face, a lower face, four peripheral sides, a first gusset section and a first vent. The first gusset section extends along at least a portion of one of the peripheral sides. At least a portion of the first vent is configured as part of the upper face. In another aspect of the present invention, the first vent is configured to be a part of the upper face, one of the peripheral sides adjacent the first gusset and the lower face.

In another aspect of the present invention, the pillow includes a second gusset section extending along a least a portion of the peripheral side opposite the first gusset and a second vent configured as part of the upper face, the peripheral side opposite the first vent and the lower face.

These, and other objects, features and advantages of this invention will become apparent from the following detailed description of the various aspects of the invention taken in conjunction with the accompanying drawings.

BRIEF DESCRIPTION OF THE DRAWINGS

One or more aspects of the present invention are particularly pointed out and distinctly claimed as examples in the claims at the conclusion of the specification. The foregoing and objects, features and advantages of one or more aspects are apparent from the following detailed description taken in conjunction with the accompanying drawings in which:

Figure 1:
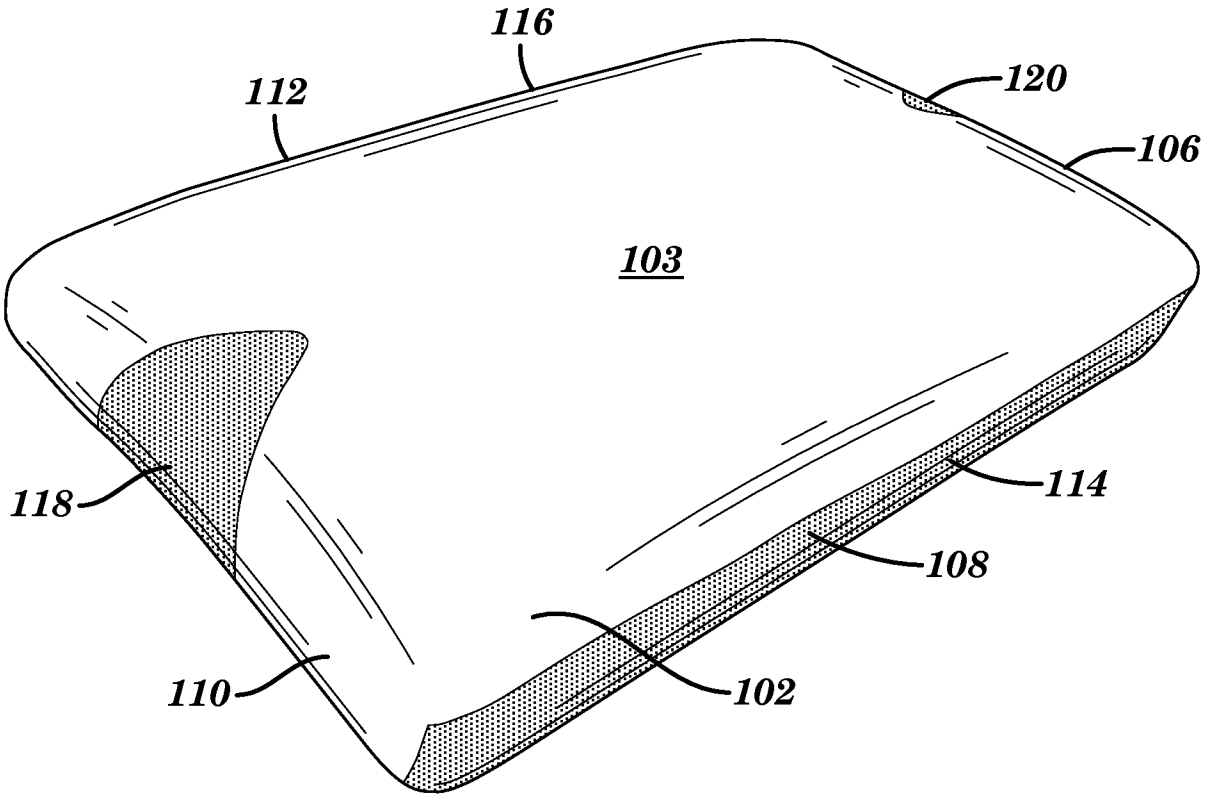
FIG. 1 depicts a perspective view of a pillow constructed in accordance with one or more aspects of the present invention.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood that the invention is not necessarily limited to the particular embodiments illustrated herein.

DETAILED DESCRIPTION OF THE INVENTION

For purposes of promoting an understanding of the principles of a pillow designed and constructed in accordance with one or more aspects of the present invention, reference will now be made to the embodiments, or examples, illustrated in the drawings and specific language will be used to describe these. It will nevertheless be understood that no limitation of the scope of the invention is thereby intended. Any alterations and further modifications in the described embodiments, and any further applications of the principles of the invention as described herein are contemplated as would normally occur to one skilled in the art to which the pillow invention relates.

Presented herein is a pillow comprising, in one embodiment, a combination of gussets along two opposite peripheral sides of the pillow and vents configured as part of an upper face and a lower face and a portion of the two other opposite peripheral sides adjacent the peripheral sides where the gussets are configured. A pillow constructed in accordance with one or more aspects of the present invention is designed to use the "venturi effect" to improve air flow by drawing air into the pillow through the gussets along the length sides of the pillow when a user's head is placed on the pillow and forcing air up through the side width vents to send cool air to the user of the pillow. By including vents configured as part of an upper and lower face of the pillows, the pillow provides improved venting through the interior of the pillow, as a user lays on the pillows and changes positions, and enhances the comfort of a user by forcing air up through the vents and not simply out the sides.

By way of example, FIG. 1 depicts a pillow 100 constructed in accordance with one or more aspects of the present invention. Pillow 100 depicted in FIG. 1 includes an upper face 102 and an opposing lower face 104 and peripheral sides 106, 108, 110 and 112. Upper face 102 is substantially identical in size and configuration as lower face or panel 102. Upper face 102 and lower face 106 are generally flat on which to place, for example, the head of a person. As depicted in FIG. 1, upper face 102 includes an upper panel 103 and a portion of vents 118 and 120, and lower face 104 includes a lower panel 105 and a portion of vents 118 and 120.

Upper panel 103 and lower panel 105 may be formed of various materials such as, for example, various textiles. For example, upper panel 103 and/or lower panel 105 may be formed of a moisture-wicking fabric, such as 100% polyester fabric, rayon, nylon, or spandex-blend fabric for increased performance and stretch-ability, which allows for moisture dispersion and, thus, heat management to cool the head and body. A cooling material, such as a gel, may be applied interiorly to upper panel 103 and/or the lower panel 105. The cooling material may be silicon or polyether gel formed into layers and applied shapes, as well as, formed ceramics, neoprene and other material technology as developed and available for use to perform heat transfer and temperature regulation function. Depending on the nature and stability of the cooling material, the cooling material may be applied internally and/or externally to upper panel 103 or lower panel 105.

Pillow 100 also includes a first gusset 114 extending along peripheral side 108 and a second gusset 116 extending along peripheral side 112 opposite peripheral side 108. In one example, first gusset 114 and second gusset 116 includes a length greater than a half inch in height. In an alternative embodiment, first gusset 114 and second gusset 116 extend along only a portion of peripheral sides 108 and 112 or extend only a portion of the height of each peripheral side 108, 112.

Figure 2:
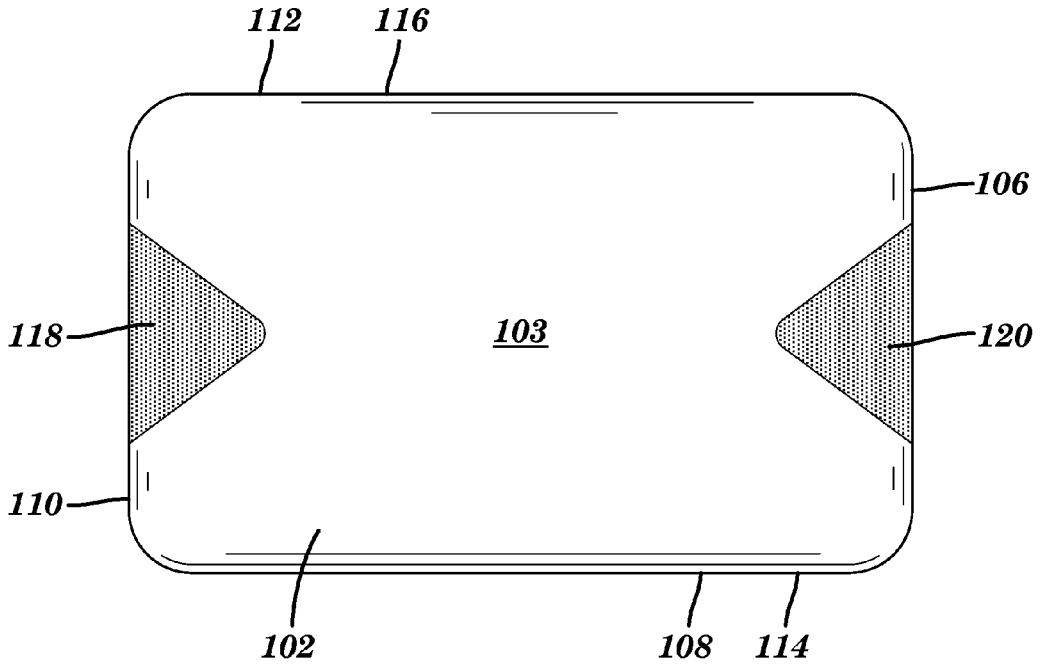
FIG. 2 depicts a top view of the pillow of FIG. 1.
Figure 3:
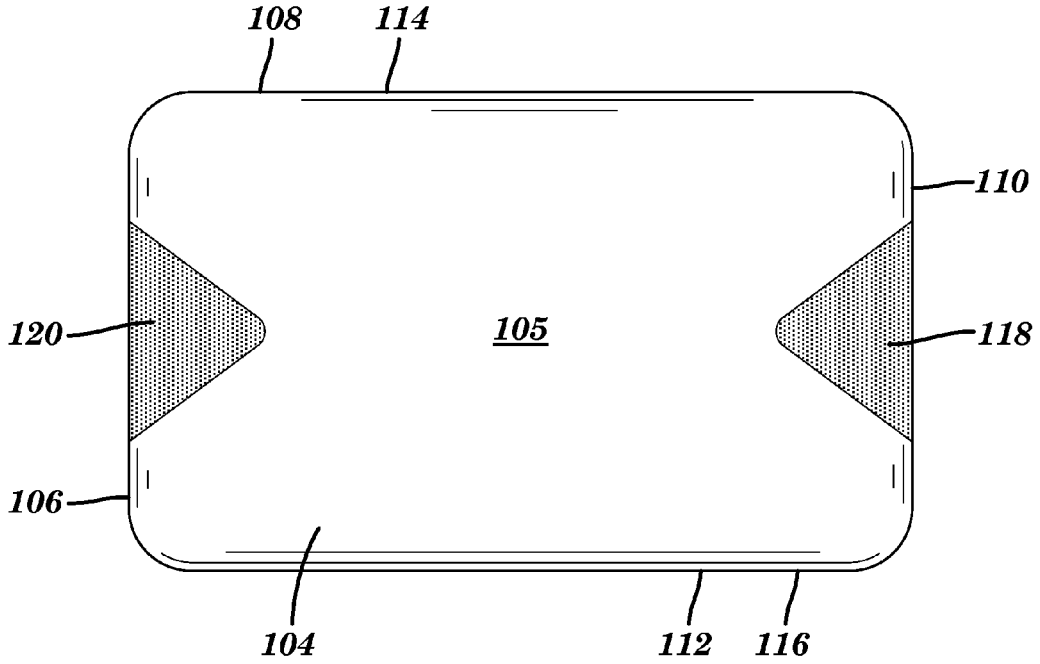
FIG. 3 depicts a bottom view of the pillow of FIG. 1.
Figure 4:
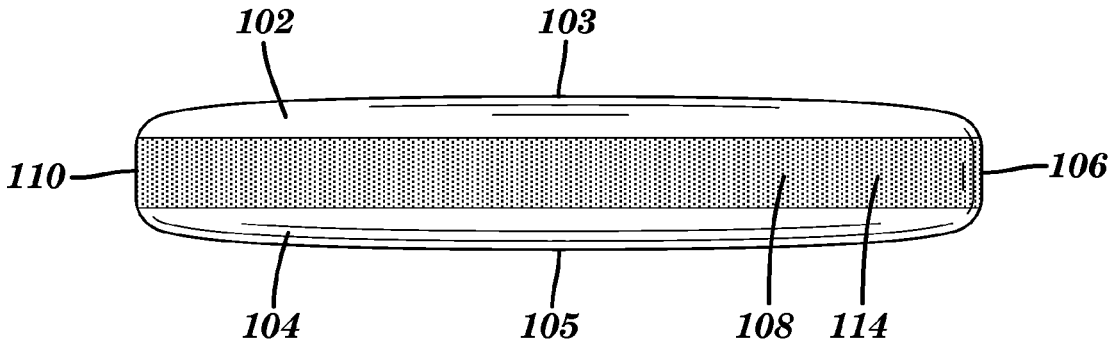
FIG. 4 depicts a front view of the pillow of FIG. 1.
Figure 5:
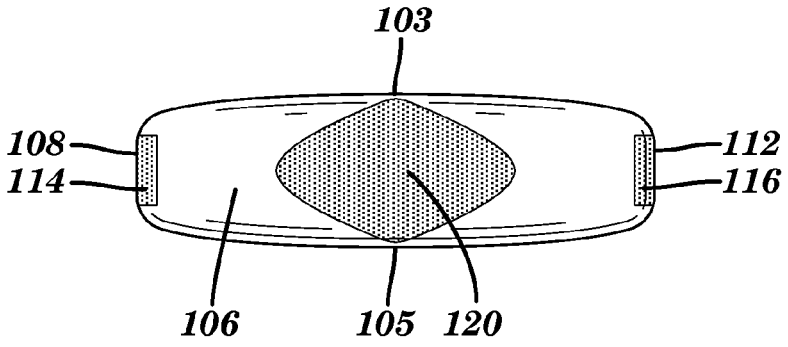
FIG. 5 depicts a side view of the pillow of FIG. 1.

As depicted in FIGS. 1-3, vent 118 is configured as part of upper face 102, peripheral side 110 and lower face 104, and vent 120 is configured as part of upper face 102, peripheral side 106 and lower face 104. In one embodiment, first vent 118 and second vent 120 do not extend the entire width or length of peripheral sides 110, 106, respectively, which allows upper face 102 to be directly connected to lower face 104 on either side of first vent 118 and second vent 120 by, for example, a portion of additional material or a continuation of the same material from upper face 102 to lower face 104. The shape of vents 118 and 120 on upper face 102 and lower face 104 may be oval, circular, oblong or football shaped, or any other shape such as, for example, rectangular. In one embodiment, the width of vents 118 and 120 may be greater than two inches long and two inches wide. In alternative embodiments, each peripheral side 106 and 110 may include multiple vents spaced along the length of each side. In yet another embodiment, vents 118 and 120 are centrally located along peripheral sides 110, 106, respectively.

Gussets 114, 116 and vents 118, 120 may have a sufficient size so as to define an air flow channel therethrough. The gussets and vents may be constructed using, for example, open cell material or spacer mesh fabrics known in the art and publicly available. In one example, the spacer mesh fabric used for the gussets may allow approximately one micron of airflow therethough. In alternative embodiments, the gussets and vents may be defined by a plurality of interlaced or spaced-apart strands arranged randomly or in various patterns, such as a "x" pattern or a rectangular pattern, or other patterns or combination of patterns. With the gussets and vents being formed of open cell construction or spacer mesh fabric, air exchange through the gussets, about the inner filler material of the pillow and out the vents is permitted. This allows for heat dissipation and minimal heat collection within the pillow.

A pillow constructed in accordance with one or more aspects of the present invention may include different fill materials. For example, the fill material may be blends of hypoallergenic polyester fibers to achieve different levels of support versus softness. Alternatively, the pillow 100 may be provided with a fill of microfiber, a blend of conjugate and hollow slick fiber, or cluster/ball fiber. As will be appreciated by those skilled in the art, other fills are possible. Various down, memory foam (solid layer(s) and/or clusters) and/or latex (solid layer(s) and/or springs), in varying combinations, may also be utilized as filler for the pillow.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

The invention claimed is:

1. A pillow, said pillow comprising:

an upper face;

a lower face;

a first set of peripheral sides;

a second set of peripheral sides, said second set of peripheral sides extends between said first set of peripheral, wherein said first set of peripheral sides and said second set of peripheral sides define an outer periphery extending along a boundary of said upper face and said lower face, wherein said upper face, said lower face, said first set of peripheral sides and said second set of peripheral sides together defining an internal cavity;

a first gusset section, said first gusset section extending along at least a portion of one peripheral side of said first set of the peripheral sides;

a second gusset section, said second gusset section extending along at least a portion of the other peripheral side of said first set of peripheral sides;

a first vent, said first vent extending along a portion of one peripheral side of said second set of peripheral sides, a portion of said upper face, and a portion of said lower face; and a second vent, said second vent extending along a portion of the other peripheral side of said second set of peripheral sides, a portion of said upper face and a portion of said lower face, wherein said first gusset section and said second gusset section are separate and distinct from said first vent and said second vent, wherein said first gusset section, said second gusset section, said first vent and said second vent are configured to allow air to enter said first gusset section and said second gusset section into the internal cavity and exit said first vent and said second vent.

2. The pillow of claim 1, wherein said first gusset section extends along the entire length of the one peripheral side of the first set of peripheral sides and the second gusset section extends along the entire length of the other peripheral side of the first set of peripheral sides.

3. The pillow of claim 1, wherein said first vent is centrally located along the one peripheral side of the second set of peripheral sides and the second vent is centrally located along the other peripheral side of the second set of peripheral sides.

4. The pillow of claim 1, wherein said first vent is not part of said first gusset section or said second gusset section and said second vent is not part of said first gusset section or said second gusset section.

5. The pillow of claim 1, wherein fabric sections extend between the boundary of said upper face and said lower face and along the outer periphery between said first vent and said first set of peripheral sides.

6. The pillow of claim 1, wherein fabric sections extend between the boundary of said upper face and said lower face and along the outer periphery between said second vent and said first set of peripheral sides.

7. The pillow of claim 1, wherein said first vent, said second vent, said first gusset section and said second gusset section are spaced along the outer periphery.

* * * * *

UNITED STATES PATENT AND TRADEMARK OFFICE

CERTIFICATE OF CORRECTION

PATENT NO. : 9,265,369 B1
APPLICATION NO. : 14/820583
DATED : February 23, 2016
INVENTOR(S) : John A. Beliveau It is certified that error appears in the above-identified patent and that said Letters Patent is hereby corrected as shown below:

Title Page, item (75): Delete "Morresville, NY" and insert -- Morrisville, NC --

Signed and Sealed this
Fifth Day of April, 2016

Michelle K. Lee

Michelle K. Lee
*Director of the United States Patent and Trademark Office*